US006763945B2

(12) United States Patent
Baker et al.

(10) Patent No.: US 6,763,945 B2
(45) Date of Patent: Jul. 20, 2004

(54) DISPENSER HAVING ONE TOUCH FLIP TOP OPENING

(75) Inventors: Paul Joseph Baker, Saylorsburg, PA (US); Jim Francis Warner, Hoboken, NJ (US)

(73) Assignee: Mars, Incorporated, McLean, VA (US)

( * ) Notice: Subject to any disclaimer, the term of this patent is extended or adjusted under 35 U.S.C. 154(b) by 235 days.

(21) Appl. No.: 10/083,961

(22) Filed: Feb. 26, 2002

(65) Prior Publication Data

US 2003/0159965 A1 Aug. 28, 2003

(51) Int. Cl.[7] ..... B65D 83/04
(52) U.S. Cl. ..... 206/540; 206/37; 222/556
(58) Field of Search ..... 206/37, 39, 528, 206/540; 215/224, 235, 237; 220/833, 834; 222/153.06, 498, 556

(56) References Cited

U.S. PATENT DOCUMENTS

| | | | | |
|---|---|---|---|---|
| 3,845,872 A | * | 11/1974 | Towns et al. | 215/224 |
| 3,850,350 A | * | 11/1974 | Towns et al. | 222/556 |
| 4,095,712 A | | 6/1978 | Perrella | |
| 4,144,985 A | | 3/1979 | Kinslow | |
| 4,371,095 A | * | 2/1983 | Montgomery et al. | 220/833 |
| 4,538,731 A | | 9/1985 | Cillario | |
| 4,607,768 A | | 8/1986 | Taber et al. | |
| 4,901,892 A | * | 2/1990 | Song | 222/556 |
| 5,273,177 A | | 12/1993 | Campbell | |
| 5,540,354 A | * | 7/1996 | Annand | 221/52 |
| 5,636,732 A | | 6/1997 | Gilels et al. | |
| 5,735,438 A | * | 4/1998 | Ostrowsky | 222/556 |
| 5,950,296 A | * | 9/1999 | Tatsumi et al. | 206/37 |
| 6,257,452 B1 | | 7/2001 | Allen | |

FOREIGN PATENT DOCUMENTS

FR 1262055 5/1961

OTHER PUBLICATIONS

International Search Report for International Application No. PCT/US03/06118.

* cited by examiner

*Primary Examiner*—Luan K. Bui
(74) *Attorney, Agent, or Firm*—Fitzpatrick, Cella, Harper & Scinto

(57) ABSTRACT

A dispenser for storing and dispensing small objects and a method of dispensing small objects with the dispenser. The dispenser has a housing, defining an interior volume and a dispensing aperture, providing access to the interior volume, a dispensing aperture closure, having a closed position for securing objects within the interior volume and a dispensing position for dispensing objects from within the interior volume. The dispenser also includes a fulcrum within the interior volume of the housing, positioned such that, when pressure is applied to a button portion of the closure, a flap portion of the closure contacts the fulcrum.

15 Claims, 2 Drawing Sheets

DISPENSER HAVING ONE TOUCH FLIP TOP OPENING

BACKGROUND OF THE INVENTION

1. Field of the Invention

The present invention generally relates to a dispenser for small objects, such as candy, pills, tablets, and other objects of similar size. In particular, the present invention relates to a dispenser having a one touch, flip top closure element, having a flap portion that opens when a button portion of the closure element is depressed.

2. Related Background Art

Dispensers for small objects, such as candy, pills, tablets, and other objects of similar size are well known in the art. Such dispensers, especially those used for candy, typically comprise a hollow body and a separately formed top portion. Typically, the hollow body has a sealed base and an open top. The top portion is a flat top surface with at least one aperture, and includes a closure element that allows access to objects within the hollow body of the dispenser through the aperture when open, while securing objects within the hollow body when closed. Both the hollow body and the top portion are typically formed by injection molding or a similar molding process known in the art. The hollow body is typically formed from a relatively rigid, transparent plastic, such as, e.g., polystyrene, and the top portion is formed from a relatively flexible plastic, such as, e.g., polyvinyl chloride.

The hollow body typically has the general shape of a right rectangular prism, but may be tapered and/or have rounded edges. The base and top opening of the hollow body are generally rectangular in shape, and the top portion is formed with a shape that allows the top portion to be inserted into or placed over the open end of the hollow portion in such a manner that the top portion and the hollow body each securely grip the other, retaining objects within the dispenser when the closure element is closed.

The closure element of known dispensers, typically comprises a generally rectangular flap that covers the aperture, which is generally formed in one end of the top portion. The flap generally is hinged at one end of the aperture near the middle of the top portion, and is configured to securely engage the top portion at the other end of the aperture, near the edge of the top portion, when closed.

For example, U.S. Pat. No. 4,538,731 to Cillario discloses a generally rectangular dispenser of the type discussed above in which the closure element is configured to reduce the amount of force required to open the closure to obtain access to the objects within the container. The dispenser can be opened with one hand by holding the dispenser in the palm of one hand and pushing up on the flap with the thumb, or with two hands by holding the dispenser in one hand, and lifting the flap with the fingers of the other hand.

Similarly, U.S. Pat. No. 5,636,732 to Gilels et al, discloses a cap for a package of chewing gum. The cap is placed on the open end of the rectangular hollow body of the package, and has a frame that surrounds the open end and a pair of hinged covers that are opened to gain access to the gum within the package through a pair of apertures.

U.S. Pat. No. 4,144,985 to Kinslow discloses a dispenser comprising a substantially rectangular container and a plug that is placed in the open mouth of the container. The plug has a top wall with an opening that is closed with a hinged flap integral with the top wall. The flap is secured by a snap-action provided by the free end of the flap and the top wall.

Closures for containers that require a pressing motion rather than a lifting motion to open are also known. U.S. Pat. No. 5,273,177 discloses a press-to-open dispensing closure comprising a flexible, partially spherical or partially cylindrical membrane having a cut or line of separation. The cut or line of separation creates a partially detached flap that acts as a flexible aperture cover. Pressing downwards on that portion of the flexible partially spherical or partially cylindrical membrane that is connected to, but not part of, the flap causes the flexible aperture cover to move upwards, uncovering an aperture in the membrane formed by the cut or line of separation. The flexible aperture cover is closed by applying pressure to the upper surface of the partially detached flap. Once the aperture cover is pushed past a certain point of resistance, the shape of the partially spherical or partially cylindrical membrane provides a pulling force that closes the aperture cover.

U.S. Pat. No. 4,095,712 to Perrella discloses a generally rectangular dispenser comprising a hollow body and a lid for closing the opening to the hollow body in the manner of a slip-on lid. The use of two separate parts facilitates the filling of the dispenser. However, the disclosed dispenser may be formed as a single piece. The lid comprises a delivery aperture, surrounded on three sides by a support and arresting rib on which a flap closure element rests when the dispenser is closed. Three sides of the flap are free of what is referred to as the "upper base" of the lid, and the fourth side of the lid is rigidly connected to the rest of the upper base. To insure the rigidity of the connection, a stiffening rib is added on the underside of the lid and upper base. The remaining portion of the upper base that does not form the flap is formed in one piece with the lid, and is beveled on at least three sides in the form of a truncated pyramid, in which the upper or minor base provides the surface on which pressure is applied to open the flap. Subjecting the minor base of the truncated pyramid distorts the lid, forcing the flap open. Releasing the pressure allows the truncated pyramid to return to its original form, closing the flap.

Because prior art dispensers typically have a generally rectangular shape with a closure on top, holding such dispensers vertically to avoid spillage when opening requires an unnatural position of the hand and wrist of the person holding the dispenser. Therefore, a need exists for a dispenser that can be opened with one hand that reduces the potential for spilling the contents, while allowing for the easy dispensing of the contents. The present invention provides such a dispenser.

SUMMARY OF THE INVENTION

The present invention is directed to a dispenser for storing and dispensing small objects and to a method of dispensing small objects with the dispenser of the invention. The dispenser of the invention comprises a housing, having an interior volume and a dispensing aperture to provide access to the interior volume, a dispensing aperture closure, and a fulcrum within the interior volume of the housing. Optionally, the dispenser also comprises a stop positioned to limit the movement of the button portion of the dispensing aperture closure, where the stop is preferably attached to or forms a portion of the fulcrum. The housing may be transparent, and, optionally, comprises separately formed, first and second sides that are attached one to the other. The dispensing aperture closure has a closed position for securing objects within the interior volume and a dispensing position for dispensing objects from within the interior volume, and comprises a flap portion, a button portion, a secured portion, a button hinge connecting the secured portion to the button portion, and a flap hinge connecting the flap portion to the button portion. The secured portion is attached to the housing, such that the dispensing aperture closure is positioned to close the dispensing aperture when the dispensing aperture closure is in the closed positioned. Preferably, the dispenser also has a fill aperture and a fill aperture door that is configured to cover the fill aperture. More preferably, the fill aperture door is substantially permanently closed after filling the dispenser through the fill aperture.

Where the dispenser housing comprises separate first housing and second housing sides, at least one of the first housing side and the second housing side preferably comprises a fill aperture door, configured and adapted to close a fill aperture formed in at least one of the first housing side and the second housing side. The fulcrum and the optional stop may be formed as integral parts of the housing, such as, e.g., as a portion of at least one of the first housing side and the second housing side.

When the dispensing aperture closure is in the closed position, the closure is opened by applying a sufficient amount of pressure on the closure button portion to bend the closure at the button hinge, and displaces at least a portion of the button portion through the dispensing aperture and into the interior volume, such that the flap portion is pressed onto the fulcrum. Contact of the flap portion with the fulcrum bends the closure at the flap hinge, and displaces the flap portion, such that the dispensing aperture closure is moved into the dispensing position.

Similarly, when the dispensing aperture closure is in the dispensing position, the closure may be closed by applying an amount pressure on the flap portion sufficient to press the flap portion onto the fulcrum, thereby bending the dispensing aperture closure at the flap hinge and the button hinge, such that the flap portion and the button portion are displaced, and the dispensing aperture closure is moved into the closed position.

Most preferably, the dispenser has an ergonomic shape, and comprises a top, a bottom, first side and second sides, and first and second ends, where a least one of the top, the bottom, the first side, the second side, the first end and the second end is curved to provide the ergonomic shape. As a result, the preferred dispenser ergonomically fits an average users right or left hand.

DETAILED DESCRIPTION OF THE INVENTION

The present invention is directed to dispenser for small objects, such as candy, pills, tablets, and other objects having a similar size. As used herein the term "small objects" refers to pieces of candy, pills, tablets, and any other object having a similar size that may be stored in and dispensed from the dispenser of the invention.

Figure 1:
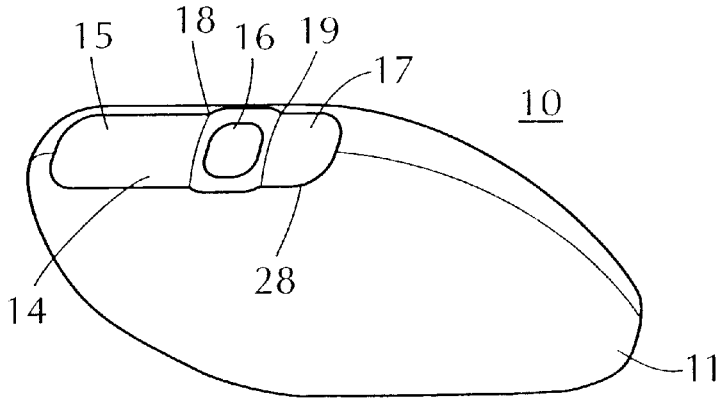
FIG. 1 illustrates a dispenser of the invention having the closure in the closed position.
Figure 2:
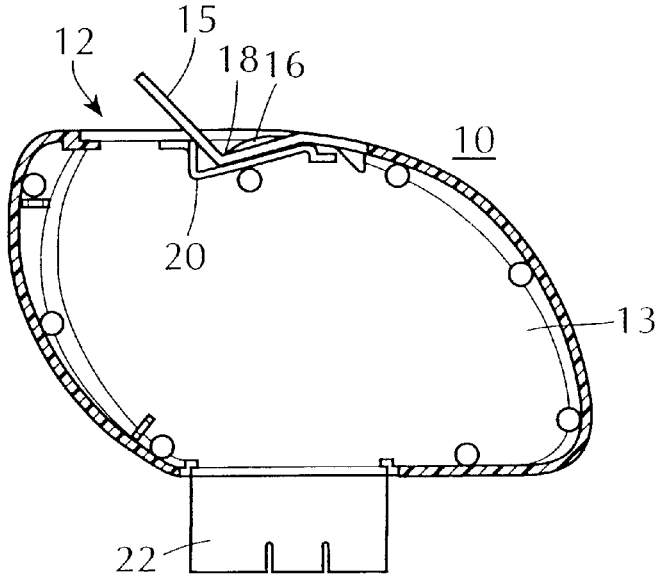
FIG. 2 is a cross section of a dispenser of the invention having the closure and the fill aperture door in the open position.

A dispenser in accordance with the invention is generally illustrated in FIG. 1 and, in cross section, in FIG. 2. Dispenser 10 comprises a housing 11, a dispensing aperture 12, an interior volume 13 within housing 11, and a dispensing aperture closure 14. Dispensing aperture closure 14 has a closed position, as illustrated in FIG. 1, and a dispensing position, as illustrated in FIG. 2.

Dispensing aperture closure 14 comprises a flap portion 15, a button portion 16, and a secured portion 17. Flap portion 15 is connected to button portion 16 by a flap hinge 18, and button portion 16 is connected to secured portion 17 by a button hinge 19. Secured portion 17 is attached to housing 11 by any means known in the art, such as, e.g., by complimentary interlocking portions of secured portion 17 and housing 11, such as a tongue and groove arrangement 28, or by an adhesive or glue. Dispenser 10 further comprises a fulcrum 20, preferably positioned within interior volume 13, such that, when button portion 16 or flap portion 15 is depressed sufficiently, flap portion 15 contacts fulcrum 20 at a point on flap portion 15 near flap hinge 18, facilitating the opening or closing of dispensing aperture closure 14, as described below.

Figure 3:
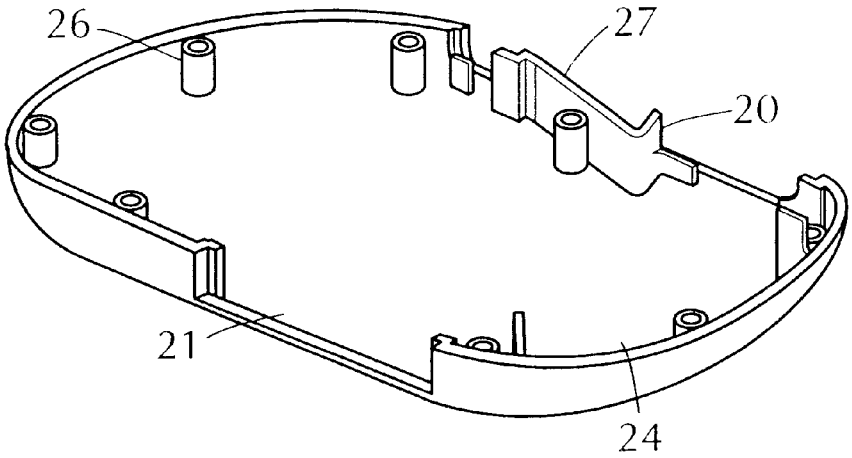
FIG. 3 illustrates a first side portion of a dispenser in accordance with the invention.

The bottom of known dispensers are generally sealed, and, thus, the contents must be added through the top opening of the hollow body before closing the opening with the top portion or through the aperture in the top portion after closing the opening with the top portion, making the filling of prior art dispensers complex. To overcome this problem, dispensers in accordance with the invention preferably comprise a fill aperture 21, separate from dispensing aperture 12, to allow for easy filling and a fill aperture door 22 to close fill aperture 21 and secure items within interior volume 13 after filling. In a preferred embodiment, fill aperture door 22 is essentially permanently closed after the dispenser is filled through fill aperture 21. Fill aperture 21 may be positioned at any point on housing 11 to allow the easy filling of dispenser 10. Preferably, fill aperture 21 is positioned on a portion of housing 11 opposite dispensing aperture 12, as shown in FIGS. 2 and 3.

Figure 4:
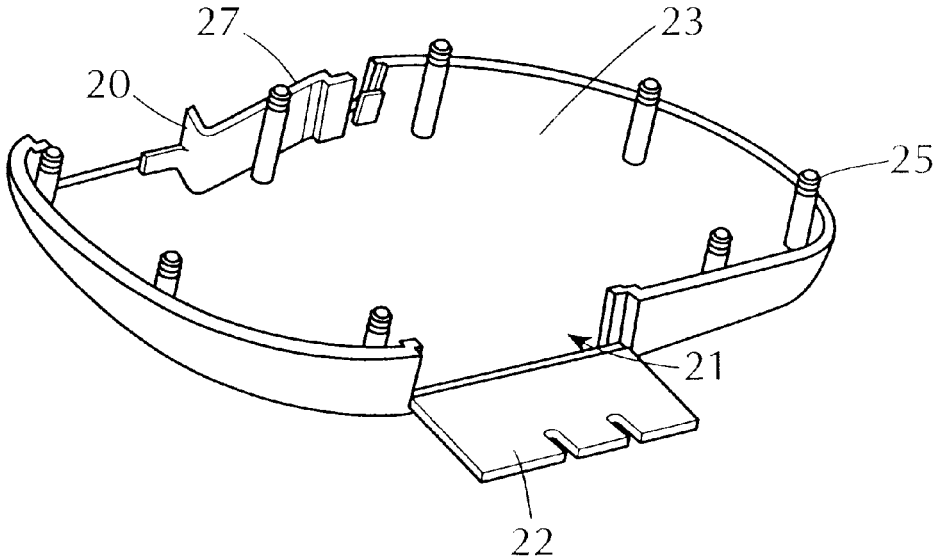
FIG. 4 illustrates a second side portion of a dispenser having the fill aperture door in accordance with the invention.

Although housing 11 may be formed in a single piece by, e.g., vacuum molding, injection molding, or blow molding, removing a one piece housing from the mold could be difficult or even impossible in some embodiments. Therefore, the housing preferably comprises first and second side portions 23 and 24 that are molded separately, and attached one to the other by any means known in the art, such as, e.g., by using the pins 25 and sockets 26 shown in FIGS. 3 and 4.

Housing 11, dispensing aperture closure 14, and fill aperture door 22 may be formed from any appropriate material, such as, e.g., polystyrene, polyvinyl chloride, or polypropylene. To allow viewing of the contents, the housing may be formed from a clear plastic, such as, e.g., polystyrene or clarified polypropylene. The preferred materials for housing 11, dispensing aperture closure 14, and fill aperture door 22 are polypropylene and clarified polypropylene.

Dispensing aperture closure 14 is preferable formed from a single piece of flexible material, such as, polypropylene or polyvinyl chloride. When dispensing aperture closure 14 is formed from a single piece, flap hinge 18 and button hinge 19 may be formed by forming closure 14 with a reduce section at hinges 18 and 19, thereby creating a "living hinge". However, as will be recognized by those skilled in the art, hinges 18 and 19 may be of any useful type known in the art, such as a hinge comprising a pin that allows two pieces to be rotatably connected. Such a hinge would require flap, button, and secured portions 15, 16 and 17 to be formed as separate pieces.

Dispensing aperture 12 of dispenser 10 is opened and closed as follows: When dispenser aperture closure 14 is in the closed position, pressure is applied to button portion 16, bending closure 14 at button hinge 19, and contacting flap portion 15 with fulcrum 20, preferably at a point on flap portion 15 near flap hinge 18. As pressure is applied to button portion 16, at least a portion of button portion 16 and flap hinge 18 are displaced through dispensing aperture 12 into interior volume 13 by bending at button hinge 19. The displacement of button portion 16 and flap hinge 18 into interior volume 13 causes flap portion 15 to contact fulcrum 20, displacing the free end of flap portion 15 away from housing 11, uncovering dispensing aperture 12, and moving dispensing aperture closure 14 into the dispensing or open position. A stop 27 may be provided to prevent the displacement of button portion 16 beyond the point at which dispensing aperture closure 14 would be pushed into the container, such that closure 14 could not be properly opened or closed.

To close dispenser 10 when dispensing aperture closure 14 is in the open position, pressure is applied to flap portion 15 to displace flap portion 15 towards housing 11 and dispensing aperture 12. The displacement causes the flap portion 15 to contact fulcrum 20, displacing flap hinge 18 and button portion 16 from within the housing 11, and allowing closure 14 to cover dispensing aperture 12. Preferably, housing 11 and flap portion 15 have complimentary shapes, such that housing 11 and flap portion 15 grip each other to prevent accidental opening of dispensing aperture closure 14. That is housing 11 and flap portion 15 may comprise a tenon and mortise, a tongue and groove, complimentary ribs, or any other means known in the art to form an operable joint.

This invention is not limited by the embodiments disclosed herein and it will be appreciated that numerous modifications and embodiments may be devised by those skilled in the art. Therefore, it is intended that the appended claims cover all such modifications and embodiments that fall within the true spirit and scope of the present invention.

What is claimed is:

1. A dispenser for storing and dispensing small objects, comprising:

a dispenser housing, defining an interior volume and a dispensing aperture, providing access to the interior volume;

a dispensing aperture closure, having a closed position for securing objects within the interior volume and a dispensing position for dispensing objects from within the interior volume, the dispensing aperture closure comprising a flap portion, a button portion, a secured portion, a button hinge connecting the secured portion to the button portion, and a flap hinge connecting the flap portion to the button portion, wherein the secured portion is attached to the dispenser housing, such that the dispensing aperture closure is positioned to close the dispensing aperture when the dispensing aperture closure is in the closed positioned; and a fulcrum within the interior volume of the dispenser housing, positioned, such that, when pressure is applied to the button portion, a portion of the flap portion of the closure contacts the fulcrum within the interior volume of the dispenser housing.

2. The dispenser of claim 1, wherein, when the closure is in the closed position, application of a sufficient amount of pressure on the closure button portion bends the closure at the button hinge, and displaces at least a portion of the button portion through the dispensing aperture and into the interior volume, such that the flap portion is pressed onto the fulcrum, thereby bending the closure at the flap hinge, and displacing the flap portion, such that the dispensing aperture closure is moved into the dispensing position; and wherein, when the dispensing aperture closure is in the dispensing position, application of a sufficient amount of pressure on the flap portion presses the flap portion onto the fulcrum, bending the dispensing aperture closure at the flap hinge and the button hinge, such that the flap portion and the button portion are displaced, and the dispensing aperture closure is moved into the closed position.

3. The dispenser of claim 1, wherein the dispenser housing defines a fill aperture, and the dispenser further comprises a fill aperture door, configured and adapted to cover the fill aperture.

4. The dispenser of claim 1, wherein the secured portion of the dispensing aperture closure is attached to the dispenser housing by a tongue and groove.

5. The dispenser of claim 1, wherein the dispenser housing comprises a first housing side and a second housing side, the second housing side formed separately from the first housing side.

6. The dispenser of claim 5, wherein at least one of the first housing side and the second housing side comprises a fill aperture door, configured and adapted to close a fill aperture defined by at least one of the first housing side and the second housing side.

7. The dispenser of claim 5, wherein at least one of the first housing side and the second housing side comprises at least a portion of the fulcrum.

8. The dispenser of claim 1, further comprising a stop positioned to limit the movement of the button portion of the dispensing aperture closure.

9. The dispenser of claim 8, wherein the stop is attached to or forms a portion of the fulcrum.

10. The dispenser of claim 1, further comprising a top, a bottom, a first side, a second side, a first end and a second end, wherein a least one of the top, the bottom, the first side, the second side, the first end and the second end is curved, such that the dispenser ergonomically fits an average users right or left hand.

11. The dispenser of claim 1, wherein the dispenser housing is substantially transparent.

12. A method of dispensing a small object, the method comprising the steps of:

providing a dispenser containing at least one small objects therein, the dispenser defining a dispensing aperture and an inner volume, and comprising a dispensing aperture closure, having a secured portion, a button portion and a flap portion, and having a closed position for securing objects within the interior volume, and a dispensing position for dispensing objects from within the dispenser;

applying pressure to the button portion when the dispensing aperture closure is in the closed position, thereby bending the closure at a button hinge, which connects the button portion to the secured portion, displacing at least a portion of the button portion through the dispensing aperture and into the inner volume of the dispenser, such that the flap portion is pressed onto a fulcrum within the inner volume of the dispenser, bending the closure at a flap hinge connecting the flap portion to the button portion, and displacing the flap portion into the dispensing position; and dispensing at least one small object from within the inner volume of the dispenser through the dispensing aperture.

13. The method of claim 12, further comprising the steps of applying pressure on the flap portion in the open position, thereby pressing the flap portion onto the fulcrum, bending the dispensing aperture closure at the flap hinge and the button hinge, displacing the flap portion and the button portion, and moving the dispensing aperture closure into the closed position.

14. The method of claim 12, further comprising the steps of providing a fill aperture and a fill aperture door in the dispenser;

placing at least one small object to be dispensed into the inner volume of the dispenser through the fill aperture; and closing the fill aperture door to secure the at least one small object.

15. A dispenser for storing and dispensing small objects, comprising:

a housing, comprising a first housing side and a second housing side, the second housing side formed separately from the first housing side, and defining an interior volume and a dispensing aperture, providing access to the interior volume;

a dispensing aperture closure, having a closed position for securing objects within the interior volume and a dispensing position for dispensing objects from within the interior volume, the dispensing aperture closure comprising a flap portion, a button portion, a secured portion, a button hinge connecting the secured portion to the button portion, and a flap hinge connecting the flap portion to the button portion, wherein the secured portion is attached to the housing, such that the dispensing aperture closure is positioned to close the dispensing aperture when the dispensing aperture closure is in the closed positioned; and a fulcrum within the interior volume of the housing, positioned such that, when pressure is applied to the button portion, a portion of the flap portion of the closure contacts the fulcrum, wherein at least one of the first housing side and the second housing side comprises at least a portion of the fulcrum.

* * * * *